US005688751A

United States Patent [19]

Cleveland et al.

[11] Patent Number: 5,688,751

[45] Date of Patent: Nov. 18, 1997

[54] SALICYLATE SALTS AS LUBRICANT ADDITIVES FOR TWO-CYCLE ENGINES

[75] Inventors: William K. S. Cleveland, Mentor; Jack L. Karn, Richmond Heights; Daniel M. Vargo, Willoughby, all of Ohio

[73] Assignee: The Lubrizol Corporation, Wickliffe, Ohio

[21] Appl. No.: 702,391

[22] Filed: Aug. 14, 1996

[51] Int. Cl.[6] ..... C10M 129/50

[52] U.S. Cl. ..... 508/518; 508/539; 44/410

[58] Field of Search ..... 508/518, 539; 44/410

[56] References Cited

U.S. PATENT DOCUMENTS

| | | | |
|---|---|---|---|
| 2,465,209 | 3/1949 | Verter | 44/69 |
| 3,362,801 | 1/1968 | Fareri et al. | 44/63 |
| 3,704,315 | 11/1972 | Strang | 508/518 |
| 3,758,282 | 9/1973 | Owen et al. | 44/69 |
| 4,828,733 | 5/1989 | Farng et al. | 508/518 |
| 5,290,463 | 3/1994 | Habeeb | 252/51.5 |
| 5,330,666 | 7/1994 | Habeeb | 508/518 |
| 5,441,653 | 8/1995 | Cleveland et al. | 252/34 |
| 5,498,353 | 3/1996 | Lin et al. | 508/518 |

FOREIGN PATENT DOCUMENTS

| | | | |
|---|---|---|---|
| 644489 | 7/1992 | Canada | 252/39 |
| 283294 | 9/1988 | European Pat. Off. . | |
| 572273 | 12/1993 | European Pat. Off. . | |
| 5194981 | 8/1993 | Japan . | |
| 748169 | 4/1956 | United Kingdom . | |
| 1570909 | 7/1980 | United Kingdom . | |

*Primary Examiner*—Jacqueline V. Howard

*Attorney, Agent, or Firm*—David M. Shold; Frederick D. Hunter

[57] ABSTRACT

Two-stroke cycle engines can be effectively lubricated by supplying to the engine a mixture of an oil of lubricating viscosity and a hydrocarbyl-substituted hydroxyaromatic carboxylic acid or an ester, unsubstituted amide, hydrocarbyl-substituted amide, ammonium salt, hydrocarbylamine salt, or monovalent metal salt thereof in an amount suitable to reduce piston deposits in said engine. The mixture supplied to the engine contains less than 0.06 percent by weight of divalent metals.

20 Claims, No Drawings

SALICYLATE SALTS AS LUBRICANT ADDITIVES FOR TWO-CYCLE ENGINES

BACKGROUND OF THE INVENTION

The present invention relates to a process for lubricating a two-stroke cycle engine, wherein the lubricant contains a hydroxyaromatic carboxy compound and is substantially free from divalent metals.

Over the past several decades the use of spark-ignited two-cycle (two-stroke) internal combustion engines has steadily increased. They are presently found in power lawn mowers and other power-operated garden equipment, power chain saws, pumps, electrical generators, marine outboard engines, snowmobiles, motorcycles and the like.

The increasing use of two-stroke cycle engines coupled with increasing severity of the conditions in which they have operated has led to an increased demand for oils to adequately lubricate such engines. In particular, piston deposits in two-stroke cycle engine can lead to scuffing and stuck rings, both of these problems can lead to loss of compression and engine failure.

Two-stroke cycle engines are generally lubricated by addition of the lubricant to the fuel and usually have no wet sump. Since the residence time of an additive molecule in the engine is very short, often less than one second, it is important that the additives, e.g., dispersants or detergents, be as chemically active and efficient as possible. The carboxy compounds of the present invention are useful in this regard as cleanliness agents and represent a significant improvement over conventional materials. Good performance is obtained at significantly reduced additive treat rates, leading to reduced levels of contaminants such as sulfur, phosphorus, and metals, in the exhaust.

U.S. Pat. No. 5,441,653, Cleveland et al., Aug. 15, 1995, discloses two-stroke cycle engine lubricant and lubricant fuel compositions comprising a composition prepared by reacting an aromatic compound of the formula

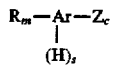

with a carboxylic reactant $R^1CO(CR^2R^3)_xCOOR^{10}$ and optionally, ammonia or amines. An example provides a lubricating oil composition including 3% polybutene, 0.15% methylene-coupled alkylnaphthalene, 15% Stoddard solvent, 4% of the above-described product, 1.5% of the sodium salt of polybutenephenol-glyoxylic acid reaction product, and 0.44% sodium alkyl salicylate.

U.S. Pat. No. 5,290,463, Habeeb, Mar. 1, 1994, discloses a lubricant composition containing the reaction product of adenine, alkoxylated amine, and hydrocarbylsalicylic acid, in a lubricating oil basestock. The composition can be used in the lubrication system of essentially any internal combustion engine, including automobile and truck engines, two-cycle engines, and the like.

SUMMARY OF THE INVENTION

The present invention provides a method for lubricating a two-stroke cycle engine, comprising supplying to the engine a mixture comprising:

(a) an oil of lubricating viscosity and (b) a hydrocarbyl-substituted hydroxyaromatic carboxylic acid or an ester, unsubstituted amide, hydrocarbyl-substituted amide, ammonium salt, hydrocarbylamine salt, or monovalent metal salt thereof in an amount suitable to reduce piston deposits in said engine;

the mixture supplied to said engine containing less than about 0.06 percent by weight of divalent metals.

The invention further provides a composition suitable for lubricating and fueling a two-stroke cycle engine, comprising:

(a) an oil of lubricating viscosity;

(b) a hydrocarbyl-substituted hydroxyaromatic carboxylic acid or an ester, unsubstituted amide, hydrocarbyl-substituted amide, ammonium salt, hydrocarbylamine salt, or monovalent metal salt thereof in an amount suitable to reduce piston deposits in said engine; and (c) a liquid fuel;

the composition containing less than about 60 parts per million by weight of divalent metals.

DETAILED DESCRIPTION OF THE INVENTION

The first component of the present invention is an oil of lubricating viscosity, including natural or synthetic lubricating oils and mixtures thereof. Natural oils include animal oils, vegetable oils, mineral lubricating oils, solvent or acid treated mineral oils, and oils derived from coal or shale. Synthetic lubricating oils include hydrocarbon oils, halo-substituted hydrocarbon oils, alkylene oxide polymers, esters of dicarboxylic acids and polyols, esters of phosphorus-containing acids, polymeric tetrahydrofurans and silicon-based oils.

Specific examples of the oils of lubricating viscosity are described in U.S. Pat. No. 4,326,972 and European Patent Publication 107,282. A basic, brief description of lubricant base oils appears in an article by D. V. Brock, "Lubricant Base Oils", *Lubrication Engineering*, Volume 43, pages 184–185, March, 1987. This article may be consulted for its disclosures relating to lubricating oils. A additional description of oils of lubricating viscosity occurs in U.S. Pat. No. 4,582,618 (column 2, line 37 through column 3, line 63, inclusive), which may be consulted for its disclosure to oils of lubricating viscosity.

The amount of the oil of lubricating viscosity is the amount suitable to complete the composition to 100%, after the other components are accounted for. Typically the amount will be 50 to 99.6 percent by weight of the lubricant composition, preferably 80 to 99 percent and more preferably 88 to 98.5 percent.

The second component of the present invention is a hydrocarbyl-substituted hydroxyaromatic carboxylic acid or an ester, unsubstituted amide, hydrocarbyl-substituted amide, ammonium salt, hydrocarbylamine salt, or monovalent metal salt thereof.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of this invention, do not alter the predominantly hydrocarbon substituent (e.g., halo (especially chloro and fluoro), hydroxy, alkoxy, mercapto, alkylmercapto, nitro, nitroso, and sulfoxy);

(3) hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

Hydroxyaromatic carboxylic acids comprise aromatic moieties substituted by at least one hydroxy group and at least one carboxylic acid group. Such a material can also be referred to as a carboxy phenol compound. When the term "phenol" is used herein, however, it is to be understood that this term is not generally intended to limit the aromatic group of the phenol to benzene, although benzene may be the preferred aromatic group. Rather, the term is to be understood in its broader sense to include, depending on the context, for example, substituted phenols, hydroxy naphthalenes, and the like. Thus, the aromatic group of a "phenol" can be mononuclear or polynuclear, substituted, and can include other types of aromatic groups as well.

Specific examples of single ring aromatic moieties are the following:

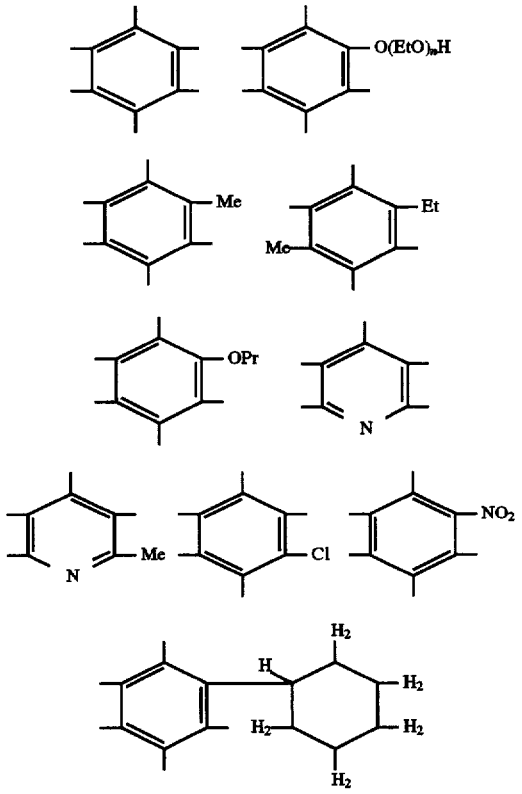

-continued

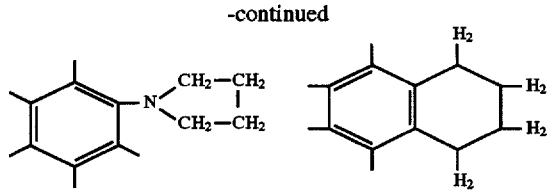

etc., wherein Me is methyl, Et is ethyl or ethylene, as appropriate, and Pr is n-propyl.

Specific examples of fused ring aromatic moieties are:

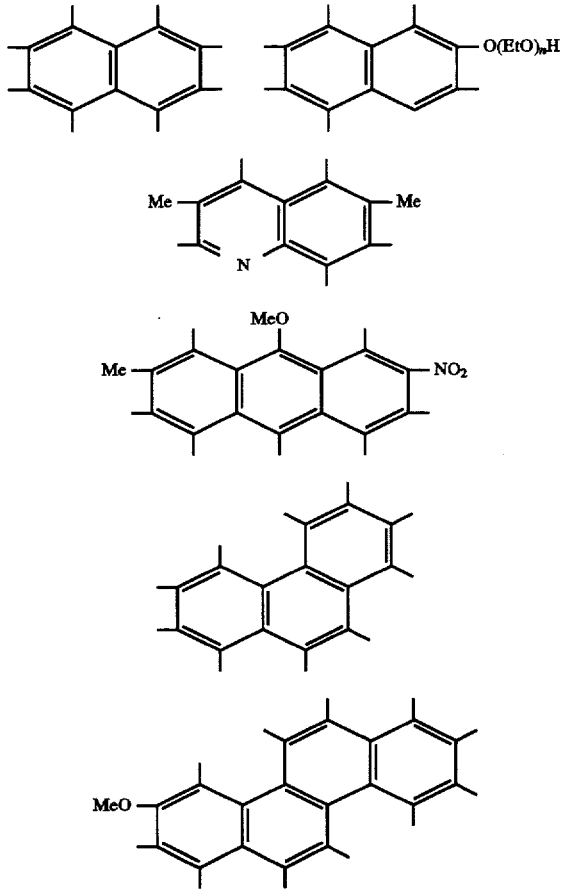

etc.

When the aromatic moiety is a linked polynuclear aromatic moiety, it can be represented by the general formula $$ar(—L—ar—)_w$$

wherein w is an integer of 1 to about 20, each ar is a single ring or a fused ring aromatic nucleus of 4 to about 12 carbon atoms and each L is independently selected from the group consisting of carbon-to-carbon single bonds between ar nuclei, ether linkages (e.g. —O—), keto linkages $$\text{(e.g., } —\overset{\overset{\displaystyle O}{\|}}{C}—\text{),}$$

sulfide linkages (e.g., —S—), polysulfide linkages of 2 to 6 sulfur atoms (e.g., $—S—_{2-6}$), sulfinyl linkages (e.g., —S(O)—), sulfonyl linkages (e.g., $—S(O)_2—$), lower alkylene linkages (e.g., $—CH_2—$, $—CH_2—CH_2—$, $$-CH_2-\underset{\underset{R^o}{|}}{CH}-)$$

mono(lower alkyl)-methylene linkages (e.g., —CHR°—), di(lower alkyl)-methylene linkages (e.g.,—$CR^o{}_2$—), lower alkylene ether linkages (e.g., —$CH_2O$—, —$CH_2O$—$CH_2$—, —$CH_2$—$CH_2O$—, —$CH_2CH_2OCH_2CH_2$—, $$-\underset{\underset{R^o}{|}}{CH_2}\underset{\underset{R^o}{|}}{CHOCH_2}CH-,\ -\underset{\underset{R^o}{|}}{CH_2}\underset{\underset{R^o}{|}}{CHOCHCH_2}-,\ \text{etc.},$$

lower alkylene sulfide linkages (e.g., wherein one or more —O—'s in the lower alkylene ether linkages is replaced with a S atom), lower alkylene polysulfide linkages (e.g., wherein one or more —O— is replaced with a —$S_{2-6}$— group), amino linkages (e.g., $$-\underset{\underset{H}{|}}{N}-,\ -\underset{\underset{R^o}{|}}{N}-,$$

—$CH_2N$—, —$CH_2NCH_2$—, —alk—N—, where alk is lower alkylene, etc.), polyamino linkages (e.g., —$N(alkN)_{1-10}$, where the unsatisfied free N valences are taken up with H atoms or R° groups), linkages derived from oxo- or keto- carboxylic acids (e.g.)

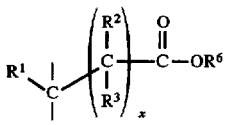

wherein each of $R^1$, $R^2$ and $R^3$ is independently hydrocarbyl, preferably alkyl or alkenyl, most preferably lower alkyl, or H, $R^6$ is H or an alkyl group and x is an integer ranging from 0 to about 8, and mixtures of such bridging linkages (each R° being a lower alkyl group).

Specific examples of linked moieties are:

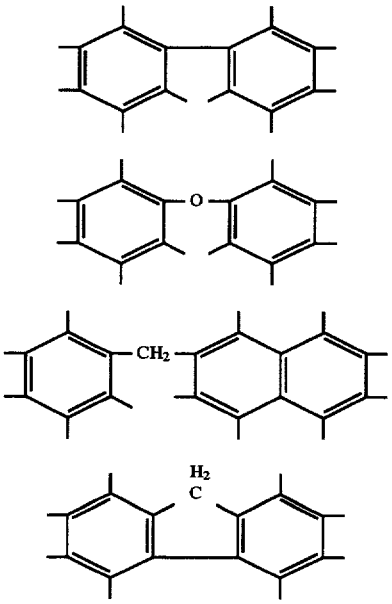

-continued

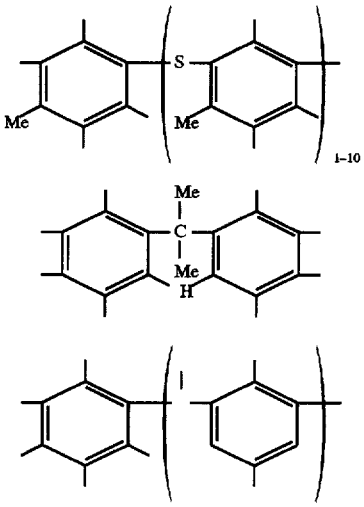

Usually all of these Ar groups have no substituents except for those specifically named. For such reasons as cost, availability, performance, etc., the aromatic group is normally a benzene nucleus, a lower alkylene bridged benzene nucleus, or a naphthalene nucleus. Most preferably the aromatic group is a benzene nucleus.

The preferred hydroxyaromatic carboxylic acids are salicylic acids, and specifically, hydrocarbyl-substituted salicylic acids, preferably aliphatic hydrocarbon-substituted salicylic acids wherein each such substituent contains an average of at least 8 carbon atoms per substituent and 1 to 3 such substituents per molecule. The substituents can likewise be polyalkene substituents, where polyalkenes include homopolymers and interpolymers of polymerizable olefin monomers of 2 to about 16, preferably 2 to 6, or 2 to 4 carbon atoms. The olefins may be monoolefins such as ethylene, propylene, 1-butene, isobutene, and 1-octene; or a polyolefinic monomer, such as diolefinic monomer, such 1,3-butadiene and isoprene. In one embodiment, the interpolymer is a homopolymer. An example of a homopolymer is a polybutene. In one instance about 50% of the polybutene is derived from isobutylene.

It is preferred that the hydrocarbyl substituent group or groups on the hydroxyaromatic carboxylic acid contain 8 to 100 carbon atoms, and preferably 10 to 30 carbon atoms. It is also preferred that the hydrocarbyl group is an alkyl group having a molecular weight of 100 to 1000, more preferably 140 to 420. The polyalkenes and polyalkyl groups are prepared by conventional procedures, and substitution of such groups onto salicylic acid can be effected by known methods.

The hydroxyaromatic carboxylic compound can be in the form of a monovalent metal salt, which is formed by known neutralization techniques from a basic monovalent metal compound. It is also permissible that the salt of the salicylic acid be a basic metal salt, also known as an overbased salt. Overbased salts are known in the art, having been described in 1954 in U.S. Pat. No. 2,695,910. They are essentially complexes of certain organic acids having metal contents which are greater than the stoichiometric amount required to neutralize the acid. Such materials are referred to in the art as overbased, superbased, hyperbased, and so on. Overbased materials generally are prepared by treating a reaction mixture comprising the salicylic acid to be overbased, a reaction medium consisting essentially of at least one inert organic solvent for the organic material, a stoichiometric excess of a metal base, a promoter, and an acid material. The methods for preparing the overbased materials as well as a diverse group of overbased materials are well known in the art and are disclosed for example in U.S. Pat. No. 4,728,578.

The metal used to prepare the metal salt is a normally monovalent metal. This encompasses the alkali metals, preferably lithium, potassium, cesium, and most preferably sodium, as well as other metals which occur normally in the +1 oxidation state under conditions encountered in lubrication; for example, silver.

The hydroxyaromatic carboxylic compound can also be in the form of an ammonium salt or a hydrocarbylamine salt (i.e., a quaternary nitrogen salt). Such salts can be prepared by well-known and ordinary means, by neutralizing the acid with ammonia or with the appropriate hydrocarbylamine. Appropriate amines can be hydrocarbyl primary, secondary, or tertiary amines.

The hydroxyaromatic carboxylic compound can also be in the form of an amide, either an unsubstituted amide or a N-hydrocarbyl- or N,N-dihydrocarbyl-substituted amide. Amides are formed, by well-known methods, by the reaction of the hydrocarbyl-substituted hydroxyaromatic carboxylic acid or a reactive equivalent thereof, with ammonia or with a hydrocarbyl primary or secondary amine.

The hydrocarbyl group or groups on the amines which form the amine salts or the N-substituted amides typically contain 1 to 24 carbon atoms, preferably 2 to 28 carbon atoms. The hydrocarbyl groups are preferably alkyl or cycloalkyl groups.

Typical hydrocarbylamines include aliphatic, cycloaliphatic, aromatic, or heterocyclic amines, including aliphatic-substituted cycloaliphatic, aliphatic-substituted aromatic, aliphatic-substituted heterocyclic, cyloaliphatic-substituted aliphatic, cycloaliphatic-substituted aromatic, cycloaliphatic-substituted heterocyclic, aromatic-substituted aliphatic, aromatic-substituted cycloaliphatic, aromatic-substituted heterocyclic-substituted alicyclic, and heterocyclic-substituted aromatic amines. The amines can be saturated or unsaturated. The amines can also contain non-hydrocarbon substituents or groups as long as these groups do not significantly alter the substantially hydrocarbon nature of the hydrocarbyl group. In general, the amine can be characterized by the formula $R^7R^8R^9N$ wherein $R^7$, $R^8$, and $R^9$ are each independently hydrogen or hydrocarbyl groups. However, at least one such R group is hydrocarbyl, and in order to form an amide, at least one R group is hydrogen.

Aliphatic monoamines include mono-aliphatic, di-aliphatic, and tri-aliphatic substituted amines wherein the aliphatic group can be saturated or unsaturated and straight or branched chain. Thus, they are primary or secondary aliphatic amines. Such amines include, for example, mono-, di-, and tri-alkyl-substituted amines, mono-, di-, and tri-alkenyl-substituted amines, and amines having one N-alkenyl substituent and one N-alkyl substituent. Specific examples of such monoamines include ethylamine, diethylamine, triethylamine, n-butylamine, di-n-butylamine, tri-n-butylamine, allylamine, isobutylamine, cocoamine, stearylamine, laurylamine, methyllaurylamine, oleylamine, N-methyl-octylamine, dodecylamine, and octadecylamine. Examples of cycloaliphatic-substituted aliphatic amines, aromatic-substituted aliphatic amines, and heterocyclic-substituted aliphatic amines, include 2-(cyclohexyl)-ethylamine, benzylamine, phenethylamine, and 3-(furylpropyl)amine.

Cycloaliphatic monoamines are those monoamines wherein there is one cycloaliphatic substituent attached directly to the amino nitrogen through a carbon atom in the cyclic ring structure. Examples of cycloaliphatic monoamines include cyclohexylamines, cyclopentylamines, cyclohexenylamines, cyclopentenylamines, N-ethylcyclohexylamine, dicyclohexylamines, and the like. Examples of aliphatic-substituted, and aromatic-substituted cycloaliphatic monamines include propyl-substituted cyclohexylamines and phenyl-substituted cyclopentylamines.

Aromatic amines include those monoamines wherein a carbon atom of the aromatic ring structure is attached directly to the amino nitrogen. The aromatic ring will usually be a mononuclear aromatic ring (i.e., one derived from benzene) but can include fused aromatic rings, especially those derived from naphthalene. Examples of aromatic monoamines include aniline, di-(paramethylphenyl) amine, naphthylamine, and N,N-di(butyl)aniline. Examples of aliphatic-substituted, cycloaliphatic-substituted, and heterocyclic-substituted aromatic monoamines are para-ethoxyaniline, para-dodecylaniline, cyclohexyl-substituted naphthylamine, and thienyl-substituted aniline.

Alternatively, the hydroxyaromatic carboxylic compound can also be in the form of an ester. The alcohols from which the esters may in principle be derived preferably contain up to 40 carbon atoms, preferably 1 to 24, more preferably 1 to 18 or 2 to 12 carbon atoms. The alcohols can be aliphatic, cycloaliphatic, aromatic, or heterocyclic, including aliphatic-substituted cycloaliphatic alcohols, aliphatic-substituted aromatic alcohols, aliphatic-substituted heterocyclic alcohols, cycloaliphatic-substituted aliphatic alcohols, cycloaliphatic-substituted aromatic alcohols, cycloaliphatic-substituted heterocyclic alcohols, heterocyclic-substituted aliphatic alcohols, heterocyclic-substituted cycloaliphatic alcohols, and heterocyclic-substituted aromatic alcohols. The alcohols may contain non-hydrocarbon substituents of a type which do not interfere with the reaction of the alcohols with the acid (or corresponding acylating agent) to form the ester. The alcohols can be monohydric alcohols such as methanol, ethanol, isooctanol, dodecanol, and cyclohexanol. Alternatively one embodiment, the alcohols can be polyhydric alcohols, such as alkylene polyols. Preferably, such polyhydric alcohols contain from 2 to 40 carbon atoms, more preferably 2 to 20; and from 2 to 10 hydroxyl groups, more preferably 2 to 6. Polyhydric alcohols include ethylene glycols, including di-, tri- and tetraethylene glycols; propylene glycols, including di-, tri- and tetrapropylene glycols; glycerol; butane diol; hexane diol; sorbitol; arabitol; mannitol; sucrose; fructose; glucose; cyclohexane diol; erythritol; and pentaerythritols, including di- and tripentaerythritol; preferably, diethylene glycol, triethylene glycol, glycerol, sorbitol, pentaerythritol and dipentaerythritol. The polyol can be in a reactively equivalent form, such as an epoxide.

Commercially available polyoxyalkylene alcohol demulsifiers can also be employed as the alcohol component. Useful demulsifiers are the reaction products of various organic amines, carboxylic acid amides, and quaternary ammonium salts with ethylene oxide. Such polyoxyethylated amines, amides, and quaternary salts are commercially available (Armour Industrial Chemical Co.) under then names Ethoduomeen T™, an ethylene oxide condensation product of an N-alkyl alkylenediamine under the name Duomeen T™; Ethomeens™, tertiary amines which are ethylene oxide condensation products of primary fatty amines; Ethomids™, ethylene oxide condensates of fatty acid amides, and Ethoquads™, polyoxyethylated quaternary ammonium salts such as quaternary ammonium chlorides. The preferred demulsifiers are liquid polyoxyalkylene alcohols and derivatives thereof.

It is also possible that the ester can be formed from a reactive equivalent of an alcohol or of a functionalized alcohol. For example, a salt of the hydroxyaromatic compound can be reacted with an alkyl halide or substituted alkyl halide to form the ester or substituted ester. Thus a sodium alkylsalicylate can be reacted with epichlorohydrin, with elimination of NaCl, to form an ester containing an epoxide functional group. This material can be used as such or it can be further reacted with, e.g., an amine or an alcohol. In another approach, sodium alkylsalicylate can be reacted with a haloalkanoamide such as 2-chloroacetamide, with elimination of NaCl, to form an ester containing an appended amide group.

In another embodiment, the hydroxyaromatic carboxylic compound can be the reaction product of a hydrocarbyl-substituted hydroxyaromatic carboxylic acid or a reactive equivalent thereof with an alkanolamine. The product can be an ester, an amide, or mixtures thereof, the structure of which may be difficult to define with chemical certainty.

Alkanolamines include condensation reaction products of at least one hydroxy compound with at least one polyamine reactant containing at least one primary or secondary amino group. The hydroxy compounds are preferably polyhydric alcohols. The polyhydric alcohols are described above. Preferably the hydroxy compounds are polyhydric amines. Polyhydric amines include any of the above-described monoamines reacted with an alkylene oxide (e.g., ethylene oxide, propylene oxide, butylene oxide, etc.) having two to about 20, or to about four carbon atoms. Examples of polyhydric amines include tri-(hydroxypropyl)amine, tris-(hydroxymethyl)amino methane, 2-amino-2-methyl-1,3-propanediol, N,N,N',N'-tetrakis(2-hydroxypropyl) ethylenediamine, and N,N,N',N'-tetrakis(2-hydroxyethyl) ethylenediamine, preferably tris(hydroxymethyl) aminomethane (THAM).

Polyamines, which can react with the polyhydric alcohol or amine to form the condensation products or condensed amines, are described above. Preferred polyamine reactants include triethylenetetramine (TETA), tetraethylenepentamine (TEPA), pentaethylenehexamine (PEHA), and mixtures of polyamines such as the above-described "amine bottoms". The condensation reaction of the polyamine reactant with the hydroxy compound is conducted at an elevated temperature, usually about 60° C. to about 265° C., (preferably about 220° C. to about 250° C.) in the presence of an acid catalyst.

Alkanolamines also include hydroxy-containing polyamines. Hydroxy-containing polyamine analogs of hydroxymonoamines, particularly alkoxylated alkylenepolyamines (e.g., N,N(diethanol)ethylenediamine) can also be used. Such polyamines can be made by reacting the above-described alkylenepolyamines with one or more of the above-described alkylene oxides. Similar alkylene oxide-alkanolamine reaction products can also be used such as the products made by reacting the aforedescribed primary, secondary or tertiary alkanolamines with ethylene, propylene or higher epoxides in a 1:1 to 1:2 molar ratio. Reactant ratios and temperatures for carrying out such reactions are known to those skilled in the art.

Specific examples of alkoxylated alkylene polyamines include N-(2-hydroxyethyl)ethylenediamine, N,N-bis(2-hydroxyethyl)ethylenediamine, 1-(2-hydroxyethyl) piperazine, mono(hydroxypropyl)substituted tetraethylenepentamine, N-(3-hydroxybutyl)tetramethylene diamine, etc. Higher homologs obtained by condensation of the above-illustrated hydroxy-containing polyamines through amino groups or through hydroxy groups are likewise useful.

The hydrocarbyl-substituted hydroxyaromatic carboxylic acid or any of the above-described derivatives thereof are present in the lubricant composition of the present invention in an amount of 0.5 to 20 percent based on the weight of the mixture or composition, and preferably 1 to 12 percent by weight.

The lubricating composition as described above will be supplied to the two-stroke cycle engine in any of a variety of ways, depending on the construction of the engine. In can be supplied to the crankcase along with air, without admixture with liquid fuel, as in a direct fuel injected two-stroke cycle engine. More commonly, it will be mixed with the fuel and the fuel-lubricant-air composition is drawn through the crankcase and thence into the combustion cylinder. Accordingly, the present invention further includes a composition suitable for fueling and lubricating a two-stroke cycle engine, comprising a liquid fuel and a lubricating amount of the lubricant described above. Such lubricant-fuel combinations are commonly employed in many two-stroke cycle engines. The lubricant can be added to the fuel when it is contained within the fuel tank; it can be premixed before the fuel is added to the tank; or it can be separately metered into the fuel stream during operation of the engine. The specific amount of the lubricant to be combined with the fuel will depend on the demands of the particular engine and the characteristics of the specific lubricant. Generally the amount of the oil of lubricating viscosity employed in the fuel is 0.5 to 10 percent by weight of the fuel plus lubricant combination, preferably 1 to 4 percent by weight. Generally the amount of the hydroxyaromatic carboxylic additive of the present invention in the fuel will be 0.002 to 1 percent by weight. In some embodiments the amount of this additive will comprise at least 0.5 percent by weight of the lubricating composition (as calculated before admixture with the liquid fuel).

The fuels used in two-cycle engines are well known to those skilled in the art and usually contain a major portion of a normally liquid fuel such as hydrocarbonaceous petroleum distillate fuel (e.g., motor gasoline as defined by ASTM Specification D-439-73). Such fuels can also contain non-hydrocarbonaceous materials such as alcohols, ethers, organo-nitro compounds and the like (e.g., methanol, ethanol, diethyl ether, methyl ethyl ether, nitromethane) are also within the scope of this invention as are liquid fuels derived from vegetable or mineral sources such as corn, alfalfa, shale, and coal. Examples of such fuel mixtures are combinations of gasoline and ethanol, diesel fuel and ether, gasoline and nitromethane, etc. Particularly preferred is gasoline, that is, a mixture of hydrocarbons having an ASTM boiling point of 60° C. at the 10% distillation point to about 205° C. at the 90% distillation point.

Two-cycle fuels also contain other additives which are well known to those of skill in the art. These may include ethers, such as ethyl-t-butyl ether, methyl-t-butyl ether and the like, alcohols such as ethanol and methanol, lead scavengers such as halo-alkanes (e.g., ethylene dichloride and ethylene dibromide), dyes, cetane improvers, antioxidants such as 2,6-di-tertiary-butyl-4-methylphenol, rust inhibitors, such as alkylated succinic acids and anhydrides, bacteriostatic agents, gum inhibitors, metal deactivators, demulsifiers, upper cylinder lubricants, anti-icing agents, additional dispersants, additional detergents, and the like. The invention is useful with lead-containing fuels but is preferably used with lead-free fuels in order to minimize the amount of divalent metals which are present.

The total amount of divalent metals present in the lubricant composition of the present invention will normally be less than 0.06 percent by weight, preferably less than 0.03 percent by weight, and more preferably less than 0.01 percent by weight. It is most preferred that the lubricant composition will be substantially or entirely free from divalent metals, and preferably similarly substantially or entirely free from polyvalent metals. Similarly, when the lubricant composition is mixed with fuel, the lubricant/fuel mixture will preferably contain less than 60 parts per million by weight of divalent metals, and will more preferably be substantially or entirely free from such metals.

The lubricant compositions employed in the present invention can also optionally contain other conventional additives for two-stroke cycle engines, including cleanliness agents such as detergents and dispersants, friction modifiers such as fatty esters, bright stock, viscosity index modifiers, olefin polymers of molecular weight about 5,000 or below, antioxidants, metal deactivators, rust inhibitors, pour point depressants, high pressure additives, anti-wear additives, and antifoam agents. Any of these materials can be present or can be eliminated, if desired. Another material commonly (but not necessarily) present in such lubricant compositions is a solvent, to aid in the solubility of the additives in the lubricant or in the fuel with which it is to be mixed. Typically such a material is a combustible solvent (other than oil of lubricating viscosity), having a flash point of less than about 105° C., in which the remaining components of the lubricant are soluble. The solvent is typically a hydrocarbonaceous solvent, that is, one which exhibits principally hydrocarbon character, even though relatively small numbers of heteroatoms may be present in the molecule. The solvent is preferably a hydrocarbon, and preferably having predominantly non-aromatic (e.g., alkane) character. The solvent thus preferably comprises less than about 3 percent by weight aromatic components and is preferably substantially free from aromatic components. (Aromatic hydrocarbons, in sufficiently large quantity, may contribute to smoke upon combustion and are thus sometimes less desirable.) A particularly suitable solvent is kerosene, which is a non-aromatic petroleum distillate having a boiling range of 180°–300° C. Another useful solvent is Stoddard solvent, which has a boiling range of 154°–202° C. The amount of the solvent is typically 15 to 55 percent by weight of the lubricant composition, preferably 20 to 50 percent, and more preferably 25 to 40 percent by weight of the composition.

In some preferred embodiments, the composition used for the lubrication method is substantially free from the condensate of an alkyl-substituted phenol and a carboxylic reactant $RCO(CRR)_xCOOR$, wherein each R is independently hydrogen or a hydrocarbyl group and x is 0 to 8. In other embodiments, the composition is substantially free from products prepared from the reaction of the above condensation products with ammonia or an amine.

The components can also be prepared and supplied in the form of a concentrate, in which, for instance a lesser amount of oil may be employed or in which less or none of the customary solvent is employed. The concentrate can be mixed directly with the fuel, or it can be first mixed with additional oil or with solvent, and this mixture then added to the fuel.

It is known that some of the materials described above may interact in the final formulation, so that the components of the final formulation may be different from those that are initially added. For instance, metal ions (of, e.g., a detergent) can migrate to other acidic sites of other molecules. The products formed thereby, including the products formed upon employing the composition of the present invention in its intended use, may not susceptible of easy description. Nevertheless, all such modifications and reaction products are included within the scope of the present invention; the present invention encompasses the use of compositions prepared by admixing the components described above.

EXAMPLES

Preparation of the Additive.

Example 1

$C_{16}$-alkylphenol (prepared by reaction of phenol with $C_{16}$ α-olefin using an acidified clay catalyst), 4007 g, diluent oil, 597 g, and xylene, 900 g, are charged to as 12L 4-necked, round bottom flask equipped with a stirrer, thermowell, sub-surface gas delivery tupe, and Dean-Stark water cooled trap. The mixture is stirred while heating to 80° C., whereupon 779 g potassium hydroxide is gradutally added. The temperature increases to 105° C.

The reaction mixture is further heated to 185° C. while removing water of reaction as a xylene azeotrope. The mixture is held at temperature, under a flow of 57L/hr (2 std. $ft^3$/hr) nitrogen for about 5 hours. The mixture is cooled to 130° C. and an additional 433 g xylene is added. The reaction mixture is treated with carbon dioxide at 17L/hr (0.6 std. $ft^3$/hr) for 24 hours at 130° C. Titration indicates 93% conversion to the potassium salt. The unfiltered reaction mass is retained as the product.

Example 2

To a 3-L flask equipped with stirrer, thermowell, thermometer, subsurface gas inlet tube, foam trap, and cold water condenser, is charged 1620 g (3.4 equivalents) crude sodium salt of $C_{13-18}$ alkyl salicylate (from Shell, containing unreacted sodium carbonate and reaction byproducts), 200 g diluent oil, and 100 g tap water. The mixture is heated to 50° C. To the mixture is added 100 mL concentrated HCl, dropwise, under a nitrogen flow of 6L/hr (0.2 std. $ft^3$/hr). After approximately 45 minutes, the mixture thickens and a moderate amount of foaming occurs. Application of heat is discontinued and addition of the HCl is interrupted, and the amount of foaming decreases. To the mixture is added 250 g toluene, and dropwise addition of HCl is resumed. The mixture is heated to 100° C. and maintained at reflux for 0.5 hours. The mixture is stripped by heating to 150° C. with a nitrogen sweep. After cooling to 100° C., the material is filtered through a filter aid, to yield sodium salt of $C_{13-18}$ alkyl salicylate, substantially free from sodium carbonate impurity.

Example 3

To a 5-L 4-necked flask equipped as in Example 1 is charged 2263 g $C_{16}$ alkyl phenol, with 343 g diluent oil and 750 g commercial aromatic hydrocarbon solvent. The mixture is heated with stirring to 85° C. At this point, 279 g NaOH beads are added over thirty minuted, during which time the temperature increases to 95° C. After addition is complete, the mixture is heated to 190° C. under a nitrogen flow of 28–57L/hr (1–2 std. $ft^3$/hr), while azeotropically removing water and solvent.

After collection of water and solvent are substantially complete, the mixture is allowed to cool. When 140° C. is reached an additional charge of 428 g aromatic hydrocarbon solvent is added, and carbon dioxide gas is blown into the mixture at 85L/hr (3 std. $ft^3$/hr) at 125°–130° C. After about 1 hour the flow of carbon dioxide is reduced to 28L/hr (1 std. $ft^3$/hr) and continued overnight. The mixture is vacuum stripped at 120°–150° C., and 274 g diluent oil are added to provide the sodium salt product.

Example 4

To a 5-L, four-necked flask equpped with a stirrer, nitrogen inlet, thermowell, and condenser, is charged (a) 1000 g of the sodium salt of $C_{13}$–$C_{18}$ alkyl substituted salicylic acid (in the form of a mixture containing 35% xylene solvent, unreacted $Na_2CO_3$, and byproducts) and (b) 1061 g of alkylsalicylic acid obtained by acidifying, stripping, and filtering an additional portion of the above mixture; to form an essentially neutral sodium alkylsalicylate. The mixture is heated, with stirring, under a nitrogen flow, to 90° C., whereupon 236.5 g 2-chloroacetamide is added over about 1 hour. The mixture is heated to reflux and maintained at this temperature for 6 hours each day for three days. The product mixture is vacuum stripped at 140° C. under 30 mm Hg. 300 g of diluent oil is added, the resulting mixture is filtered through filter aid to give a solution of product, believed to be an ester-amide represented by $$R—Ar(OH)—COOCH_2CONH_2.$$

Example 5

Into a 2-L reaction flask fitted with stirrer, thermowell, and reflux condenser is charged 760 g methyl salicylate and 35 g acidified clay catalyst (Superfiltrol™, available from Englehard, having an acidity of 5 mg KOH/g). The mixture is stirred with heating. To the mixture is added 224 g $C_{14-18}$ α-olefin; the heating is continued to 120° C. and the mixture is maintained at this temperature for 4 hours. The mixture is filtered to remove catalysts, then stripped at 175° C. at 2.7 kPa (20 mm Hg) to remove volatiles and unreacted methyl salicylate. The residue is the desired $C_{14-18}$ alkyl methyl salicylate.

Example 6

To the alkyl methyl salicylate prepared in Example 5 is added 90 g ethylene diamine. The mixture is heated, with stirring, to 120° C. and maintained at this temperature for 4 hours under distillation conditions, removing methanol. The reaction mixture is then stripped at 150° C. at 6.7 kPa (50 mm Hg), removing excess ethylene diamine. The residue is filtered using diatomaceous earth filter aid. The filtrate is the product.

Example 7

To a 12L 4-necked flask fitted with a stirrer, thermowell, submerged gas inlet tube, and dry ice-acetone reflux condenser are charged 5792 g predominantly $C_{20-30}$ alkyl substituted salicylic acid (as solution with about 30% diluent oil), and 2.5 g $LiOH.H_2O$. The mixture is heated, with stirring, to 105° C., at which time ethylene oxide is blown into the mixture at L/hr (1.5 std. $ft^3$/hr) until a 261 g weight gain is registered in the flask. The temperature is increased to 150° C. and the mixture stripped of volatiles at 4.7 kPa (35 mm Hg). The residue is the product, the ethylene glycol monoester.

Example 8

To a 5L 4-necked flask equipped with a stirrer, thermometer, dropping funnel, Dean-Stark take-off, and condenser, were placed 2800 g of the potassium salt of predominantly $C_{20-30}$ alkylsalicylic acid (as solution with 32% diluent oil) and 500 mL toluene. The mixture is heated, with stirring, to 48° C. To the mixture is added 365 g concentrated hydrochloric acid, dropwise over 1 hour. Nitrogen is bubbled into the mixture at 28L/hr (1 std. $ft^3$/hr), and the heating is temperature is increased from 53°–97° C. over 2.5 hours. Under continuing nitrogen flow, the mixture is refluxed at 100°–127° C. for 4.5 hours, as water is removed through the Dean-Stark take-off. Crystals of solids, presumed to be KCl, are present in the mixture. The mixture is cooled to 50° C. and filtered through filter aid, removing the KCl. The mixture is stripped of solvent at 122° C. at 3.5 kPa (26 mm Hg). The residue is the alkyl salicylic acid in mineral oil.

Examples 9–22

Formulation of Lubricants.

The following compositions are prepared, with the weight percent components as indicated:

| Ex. | 9 | 10 | 11 | 12 | 13 | 14 | 15 | 16 |
|---|---|---|---|---|---|---|---|---|
| Na $C_{9-18}$-alkyl salicylate[a] | 4.3 | | 3.3 | | | | | |
| Na $C_{13-18}$-alkyl salicylate[a] | | 4.3 | | 3.3 | 3.3 | 3.3 | 4.3 | 4.3 |
| Polyisobutylene, 940 $M_n$ | 3.0 | 3.0 | 3.0 | 3.0 | 3.0 | 3.0 | 3.0 | 0 |
| Aromatic pour point depressant | 0.15 | 0.15 | 0.15 | 0.15 | 0.15 | 0.15 | 0.15 | 0.2 |
| Polybutenyl ($M_n$ 900) phenol | 0 | 0 | 0 | 0 | 1.0 | 0 | 0 | 0 |
| Stoddard Solvent | 15 | 15 | 15 | 15 | 15 | 15 | 15 | 15 |
| Oils: 600 N | 65.9 | 65.9 | 66.8 | 66.8 | 67.6 | 66.8 | 66.8 | 68.4 |
| 150 N | 11.6 | 11.6 | 11.8 | 11.8 | 11.9 | 11.8 | 11.8 | 12.1 |

| Ex. | 17 | 18 | 19 | 20 | 21 | 22 |
|---|---|---|---|---|---|---|
| K salt of Ex. 1 | 1.0 | | | | | |
| Ester-amide of Ex. 4 | | 0.9 | | | | |
| Methyl ester of Ex. 5 | | | 3.0 | | | |
| Ethylene diamine product of Ex. 6 | | | | 3.0 | | |
| Ester of Ex. 7 | | | | | 8.0 | |
| Acid of Ex. 8 | | | | | | 20 |
| Polyisobutylene (940 $M_n$) | 3 | 0 | 0 | 1 | 3 | 5 |
| Stoddard Solvent | 5 | 18 | 0 | 0 | 10 | 15 |
| Oil: 600 N | 0 | 40.5 | 90 | 82 | 66 | 60 |
| 150 N | 91 | 40.5 | 7 | 14 | 13 | 0 |

[a]Approx. 50% active chemical, in diluent oil

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil which may be customarily present in the commercial material, unless otherwise indicated. As used herein, the expression "consisting essentially of" permits the inclusion of substances which do not materially affect the basic and novel characteristics of the composition under consideration.

What is claimed is:

1. A method for lubricating a two-stroke cycle engine, comprising supplying to the engine a mixture comprising:

(a) an oil of lubricating viscosity and (b) a monovalent metal salt of a hydrocarbyl-substituted hydroxyaromatic carboxylic acid in an amount suitable to reduce piston deposits in said engine;

the mixture supplied to said engine containing less than about 0.06 percent by weight of divalent metals.

2. The method of claim 1 wherein the mixture supplied to said engine contains less than about 0.03 percent by weight of divalent metals.

3. The method of claim 1 wherein the mixture supplied to said engine contains less than about 0.01 percent by weight of divalent metals.

4. The method of claim 1 wherein the mixture supplied to said engine is substantially free from divalent metals.

5. The method of claim 1 wherein the mixture supplied to said engine is substantially free from polyvalent metals.

6. The method of claim 1 wherein the hydrocarbyl substituent on the hydroxyaromatic carboxylic compound contains about 8 to about 100 carbon atoms.

7. The method of claim 1 wherein the hydrocarbyl substituent on the hydroxyaromatic carboxylic compound contains about 10 to about 30 carbon atoms.

8. The method of claim 1 wherein the monovalent metal is sodium, potassium, lithium, or cesium.

9. The method of claim 1 wherein the monovalent metal is sodium.

10. The method of claim 1 wherein component (b) comprises about 0.5 to about 20 percent by weight of the mixture.

11. The method of claim 1 wherein component (b) comprises about 1 to about 12 percent by weight of the mixture.

12. The method of claim 1 wherein the mixture further comprises a solvent.

13. The method of claim 1 wherein the mixture further contains additional conventional additives for lubricating a two-stroke cycle engine.

14. The method of claim 1 wherein the mixture is further admixed with (c) a liquid fuel and the fuel mixture is supplied to the engine.

15. The method of claim 14 wherein the amount of component (b) in the fuel mixture is about 0.002 to about 1 percent by weight.

16. The method of claim 14 wherein the amount of the oil of lubricating viscosity (a) in the fuel mixture is about 0.5 to about 10 percent by weight.

17. The method of claim 14 wherein the fuel mixture contains less than about 60 parts per million by weight divalent metals.

18. The method of claim 14 wherein the fuel mixture is substantially free from divalent metals.

19. The method of claim 14 wherein components (a) and (b) are supplied as a concentrate which is subsequently mixed with the fuel (c).

20. A composition for lubricating and fueling a two-stroke cycle engine, comprising:

(a) an oil of lubricating viscosity;

(b) a monovalent metal salt of a hydrocarbyl-substituted hydroxyaromatic carboxylic acid in an amount suitable to reduce piston deposits in said engine; and (c) a liquid fuel;

the composition containing less than about 60 parts per million by weight of divalent metals.

* * * * *

UNITED STATES PATENT AND TRADEMARK OFFICE

CERTIFICATE OF CORRECTION

PATENT NO. : 5,688,751

DATED : November 18,1997

INVENTOR(S) : William K. S. Cleveland, et al.

It is certified that error appears in the above-identified patent and that said Letters Patent is hereby corrected as shown below:

On the title page, item [75] inventors should read:

William K.S. Cleveland, Mentor;

Jack L. Karn,Richmond Heights; all of Ohio

Signed and Sealed this

First Day of June, 1999

*Attest:*

Q. TODD DICKINSON

*Attesting Officer*

*Acting Commissioner of Patents and Trademarks*